United States Patent [19]

Stafford, Jr.

[11] 4,396,136

[45] Aug. 2, 1983

[54] TENNIS BALL HOLDER

[76] Inventor: William J. Stafford, Jr., 6 Vivian Ct., Fair Lawn, N.J. 07410

[21] Appl. No.: 326,617

[22] Filed: Dec. 2, 1981

[51] Int. Cl.[3] ..... A63B 61/00

[52] U.S. Cl. ..... 224/245; 224/224; 224/919; 206/315 B

[58] Field of Search ..... 224/224, 245, 919; 206/315 B; 273/320

[56] References Cited

U.S. PATENT DOCUMENTS

| | | | |
|---|---|---|---|
| 1,814,887 | 7/1931 | Bender | 224/919 X |
| 2,548,330 | 4/1951 | Wiseman | 224/245 |
| 4,068,785 | 1/1978 | Goudreau | 224/919 X |

*Primary Examiner*—Steven M. Pollard
*Attorney, Agent, or Firm*—Weingram & Klauber

[57] ABSTRACT

A ball carrier for tennis balls and the like adapted to be worn about the waist of an individual player. The carrier is in the form of a belt encircling the waist to which one or more cup-shaped, resilient plastic ball holders are fixedly attached. Each of the ball holders is preferably hemispherical and has a flattened base portion which is attached to the belt and which stabilizes the cup-shaped ball holder. Internally projecting ribs extending inwardly from the rim of the holder parallel to the axis of the sphere are provided to firmly grasp and hold the ball when it is inserted.

10 Claims, 3 Drawing Figures

TENNIS BALL HOLDER

BACKGROUND OF INVENTION

1. Field of Invention

This invention relates to ball carrier devices, especially for tennis balls and the like, adapted to be worn by a player. More specifically, the invention relates to a ball carrier in the form of a belt to be worn by a player about the waist, to which are relatively permanently affixed one or more cup-shaped resilient ball holders for firmly but removeably retaining a ball.

2. Prior Art

In the course of playing tennis and similar games, the player requires that a plurality of playing balls be rapidly accessable, so that successive balls may be placed in play upon a proceding ball being fouled or otherwise hit out of play. Players commonly deal with this problem by carrying extra balls in their pockets or by placing extra balls at a ground location. Neither of their techniques, however, are truly effective.

In an effort to solve this problem, various ball carrier devices to be worn by an individual player either by attachment to a belt worn by the player about the waist, or as clip-on attachments, have been described in the prior art. Clip-on devices have a major disadvantage that in sports involving considerable physical activity, e.g. tennis, or ping-pong, the clip can become loose and fall off. While belts to which ball holders are fixedly attached have also been described, such ball holders are cumbersome, and rather expensive to manufacture, and in some instances, are hazardous in use.

Thus, in U.S. Pat. No. 1,814,887, a belt is described which is to be worn by a basball umpire and which carries a number of baseballs for use. The belt has a plurality of spaced resilient open-ended supports, each in the form of two U-shaped flat spring members which are connected together in a cruciform at their base and attached to a belt to prevent rotation, one for each ball. Aside from the complexity of this construction, the projecting spring arms present a possible hazard to the wearer and the other players.

U.S. Pat. No. 2,074,180 describes a tennis ball holder comprising a pair of resiliently-mounted wire rings of approximately the same diameter as a tennis ball which are attached to a base, which in turn, hooks onto the belt or shorts of the player. U.S. Pat. No. 2,548,330 describes a golf ball holder formed of molded plastic material consisting of two hemispherical compartments to accept the golf balls which are held in place by two detents in the upper portion of each compartment. A clip is molded in the rear to fasten to the golfer's belt.

U.S. Pat. No. 3,873,009 describes a tennis ball holder including a base and a retaining ring which are formed together by means of a protrusion on the ring snapping into a recess in the upper portion of the base. The base has a cavity defining a spherical portion which is less then a hemisphere to accept a tennis ball. The base also has an integral clip composed of two fingers which clip over a player's shorts or pockets.

U.S. Pat. No. 4,062,482 describes a one-piece device for holding balls formed of resilient plastic and having an integral clip for attaching to the top edge of a wearer's garment.

SUMMARY OF INVENTION

In accordance with the present invention, the ball holder is fixedly or permanently attached to a belt which is adapted to be worn about the waist. The ball holder is cup-shaped and formed, preferably in one-piece, of resilient plastic so that the ball can be removably inserted and firmly held in place.

The base of the cup, which is preferably hemispherical, is flattened to stabilize the cup which is then attached to the belt by a rivet or similar fastening means.

To improve retention of the ball, a plurality of internally projecting ribs extending inwardly from the inner periphery of the cup-shaped holder are provided, which firmly hold the ball in the cup until it is removed.

It is an object of the invention to provide a ball carrier which can be worn by a player and which firmly holds a ball until removed for use.

It is another object of the invention to provide a ball carrier in the form of a belt which can be worn about the waist of the player and which can carry one or more balls without fear that the ball will be displaced from the carrier during playing.

It is still another object of the invention to provide a ball carrier which is simple to make and to use.

It is a further object of the invention to provide a ball carrier adapted to be worn by a player which may be manufactured using relatively inexpensive materials.

It is a still further object of the invention to provide a ball carrier adapted to be be worn by a player using readily available materials.

It is yet another object of the invention to provide a resilient, plastic, cup-shaped ball holder fixedly secured to a belt adapted to be worn about the waist of a player, which ball holder firmly retains a ball until removed by the player.

It is a still further object of the invention, to utilize a unitary molded plastic cup-shaped holder for a ball which is fixedly secured to a belt adapted to be worn by a player.

Other objects and details of the invention will become apparent from the following description when read in conjunction with the drawings. However, it is to be understood that the description is exemplary only, the invention being defined in the claims following this specification. Moreover, it is to be understood that the invention is not limited in application or use to tennis balls, but may be used by other than tenmis players for carrying golf balls, ping-pong balls, baseballs, and the like.

DETAIL DESCRIPTION OF THE PREFERRED EMBODIMENT

Figure 1:
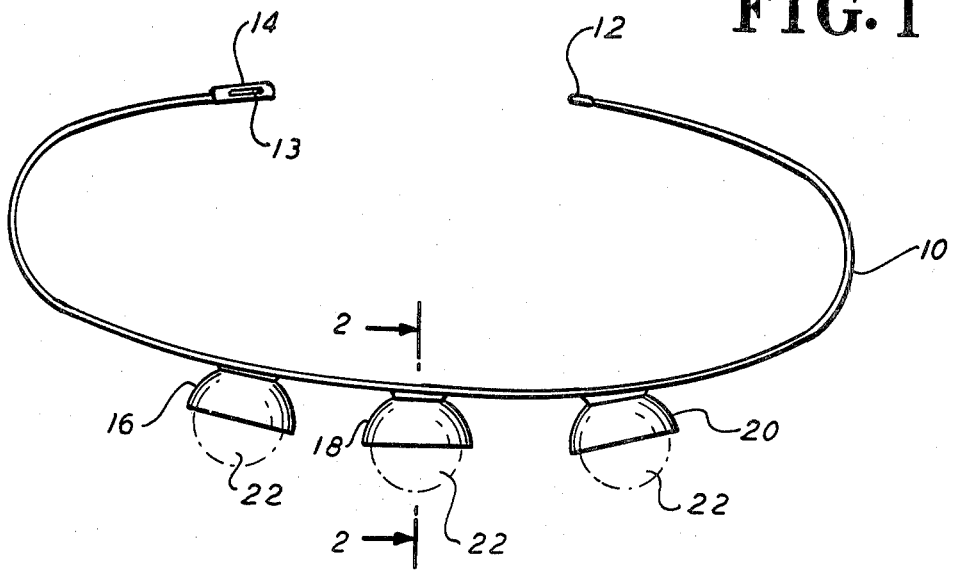
FIG. 1 is a top plan view of a ball carrier in the form of a belt carrying three cup-shaped ball holders.

As shown in the drawings, the ball carrier is in the form of a belt 10, e.g. of the woven net type commonly worn by military personnel, having a buckle in the form of a tongue 12 which slides into slot 13 of a holder 14. Belt 10 can be of any other convenient type. In the embodiment shown, three cup-shaped holders 16, 18, and 20 each adapted to hold a ball 22 are secured to the belt. Of course, more or less than three such holders may be secured to the belt 10, which can be worn about the waist of a player.

Figure 2:
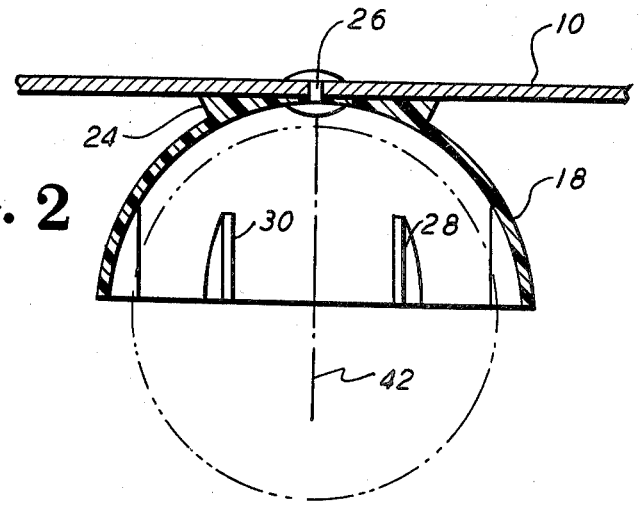
FIG. 2 is a sectional view along the lines 2—2 in FIGS. 1 and 3.
Figure 3:
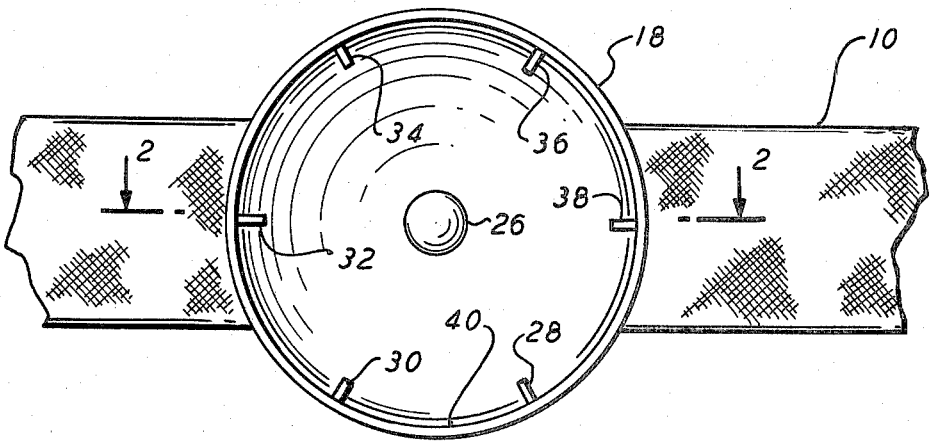
FIG. 3 is a front elevational view of an individual ball holder attached to a belt.

Each of the cup-shaped holders is preferably hemispherical, as shown in FIG. 2, and has a flattened base portion 24 which is fixedly attached to the belt by a rivet 26. This flattened base portion serves to stabilize the cup-shaped holder to prevent it from rocking and discharging a ball.

The inner surface of the hemispherical holder 18 is provided with internal projections 28, 30, 32, 34, 36, and 38. These projections extend inwardly from the inner periphery 40 parallel to the axis of the hemisphere whose axis is at 42. These projections firmly grasp the ball preventing the ball from leaving the holder during play, but allowing the player to easily remove the ball.

Preferrably, the cup-shaped holder is molded in one piece from a resilient plastic, such as polyethylene.

The player may either insert balls in each of the holders by pressing the ball into the holder and then encircle his waist and buckle the belt, or he may first don the belt, and insert as many balls as desired, each in a holder. The player can now freely enter play without fear that a ball may inadvertently fall out because the ball is firmly held in each cup-shaped holder. Yet, as needed, a ball is easily removed from the holder.

Other modifications will be apparent to those skilled in the art. Thus, the buckle could be replaced by a clasp. The belt could be of another material than a woven net. Other fastenings could be used in place of a rivet. Other resilient plastics are available.

Accordingly, the invention is not limited to this exemplary embodiment, but is pointed out and defined in the following claims.

I claim:

1. A ball carrier comprising an elongated belt adapted to be worn about the waist of an individual, a ball holder secured to said belt, and said ball holder comprising a resilient hemispherical cup-shaped member into which a ball can be removeably inserted and which firmly holds ball when the belt is worn by the individual, said member including a plurality of inwardly projecting fin-like ribs extending from the internal periphery of the cup-shaped hemispherical member inwardly parallel to the central axis of the hemisphere for retaining a ball in the holder, said ribs merging with the inner surface of said hemisphere in the direction of the closed end of the hemisphere; and means to fixedly attach the base of said cup-shaped holder to said belt.

2. A ball carrier as claimed in claim 1 in which said holder is formed of a resilient plastic material.

3. A ball carrier as claimed in claim 2 in which the plastic material is polyethylene.

4. A ball carrier as claimed in claim 2, or 3 in which the cup-shaped holder has a flattened base portion which is attached to the belt and stabilizes the cup-shaped holder.

5. A ball carrier as claimed in claims 2 or 3 in which the cup-shaped holder is molded in one piece.

6. A ball carrier as claimed in claim 1 in which the belt is a woven web.

7. A ball carrier comprising a belt adapted to be worn around the waist of an individual, a cup-shaped, hemispherical resilient plastic ball holder into which a ball can be removeably inserted secured to said belt, said cup-shaped holder being provided with a plurality of spaced fin-like ribs which project inwardly from the periphery of said cup to engage a ball inserted therein; and said ribs extending parallel to the central axis of the hemisphere and merging with the inner surface of said hemisphere in the direction of the closed end of the hemisphere said cup-shaped ball holder having a flattened base portion adapted to be attached to said belt, and means to fixedly attach said cup-shaped ball carrier to said belt.

8. A ball carrier as claimed in claim 7 in which the ball carrier is attached to the belt by a rivet.

9. A ball carrier as claimed in claim 7 in which the ball carrier is molded in one piece.

10. A ball carrier as claimed in claim 9 in which the ball holder is polyethylene.

* * * * *